United States Patent [19]

Choi

[11] Patent Number: 5,019,005

[45] Date of Patent: May 28, 1991

[54] METHOD FOR THE FABRICATION OF A DIRECT-HEATED CATHODE STRUCTURE AND AN APPARATUS THEREFOR

[75] Inventor: Kyungseok Choi, Seoul, Rep. of Korea

[73] Assignee: Samsung Electron Devices Co., Ltd., Rep. of Korea

[21] Appl. No.: 436,895

[22] Filed: Nov. 15, 1989

[30] Foreign Application Priority Data

Jul. 10, 1989 [KR] Rep. of Korea ..... 89-10090

[51] Int. Cl.[5] ..... H01J 9/06

[52] U.S. Cl. ..... 445/36; 445/49; 72/312; 72/382

[58] Field of Search ..... 313/341, 345, 292, 446; 445/36, 29, 49; 72/306, 312, 382, 397

[56] References Cited

U.S. PATENT DOCUMENTS

| | | | |
|---|---|---|---|
| 2,847,053 | 8/1958 | Hardman | 72/397 |
| 3,631,291 | 12/1971 | Favreau | 313/345 |
| 4,195,246 | 3/1980 | Izumida et al. | 313/345 X |
| 4,338,542 | 7/1982 | Takanashi et al. | 313/341 X |

FOREIGN PATENT DOCUMENTS

| | | | |
|---|---|---|---|
| 44744 | 3/1984 | Japan | 313/345 |

*Primary Examiner*—Kenneth J. Ramsey
*Attorney, Agent, or Firm*—Handal & Morofsky

[57] ABSTRACT

A method for fabricating a direct-heated cathode structure comprising a bending process wherein the bending is carried out by a plurality of hollow punches, those are assembled around a center shaft with each cushion springs of different elastic moduli inside the hollows thereof and press a filament material with time intervals between each punches thus making the filament material corrugate-ended; and a welding process wherein an end of corrugate-ended filament is put on an upper end of bended lead bar, then electrodes of an electric resistance welder are put on the filament end and beneath said lead bar end respectively to carry out the welding. Also, an apparatus which is suitable to carry out the method comprising a corrugate bender assembly and a welding jig assembly so being prepared to perform said bending process and said welding process respectively.

8 Claims, 8 Drawing Sheets

METHOD FOR THE FABRICATION OF A DIRECT-HEATED CATHODE STRUCTURE AND AN APPARATUS THEREFOR

BACKGROUND OF THE INVENTION

This invention relates to a method for the fabrication of a direct-heated cathode structure and an apparatus which is suitable to carry out the method, and more particularly to a newly improved method for the fabrication and an apparatus so prepared to properly fabricate a direct-heated cathode structure which include a filament that heat its cathode pellet and absorb the deformation by heat expansion for itself.

While advantages of a direct-heated cathode structure are its low power consumption rate and quick starting characteristic because its heat loss is lessened and its starting time is shortened by placing its cathode pellet on the filament directly, disadvanages thereof are in that heated filament cause tension changes in itself with change of disposition interspace between the first grid and cathode pellet concurred.

These disadvantages affect on cut off voltage during the operation of cathode-ray tube thus deteriorating white balance.

To solve this problem, a structure so constructed that springs supporting the filament at its both ends may absorb the thermal expansion is employed hitherto, however this kind of structure can hardly be miniaturized and it needs a plurality of fabrication processes thus causing productivity in the fabrication of the direct-heated cathode structure difficult to be enhanced.

Different from the above mentioned direct-heated cathode structure, another one disclosed in U.S. Pat. No. 4,195,246 have its both ends of filament bended so as to render the filament itself absorb the tension change originated from thermal expansion.

This manner of solution to the present problem suggested a remarkable structure for direct-heated cathode structures, however it is somewhat dissatisfying in respect to the miniaturization of the structure because of its filament bended across the direction that link upper ends of two lead bars.

A direct-heated cathode structure with a corrugate-ended filament that not only itself function as a spring but also accomplished the miniaturization in its volume by getting its end bent in a zigzag pattern is proposed recently and employed for electric view finders which need subminiature electron guns.

However, difficulties which come across during the fabrication of this kind of direct-heated cathode structure are caused by the increased number of processes which the filament have to undergo through so as to have its ends corrugated and in a welding process wherein the corrugated filament is connected to lead bars.

To put it rather concretely, it can be said that we have to undergo through a plurality of pressing processes because corrugate bending of the filament must yield a homogeneous product that is free from residual stresses arisen by pressing, and we have to bear with the corresponding difficulty in electric resistance welding because the filament and lead bars connected to it are of thin and narrow strip shapes.

Therefore this kind of directed-heated cathode structure confronts problems that: the number of processes are increased and equipments relevant to these processes become oversized because it have to undergo through pressing processes of many steps, and a jig of complicated structure is required to fix the tungsten filament on lead bars temporarily to enable the welding.

SUMMARY OF THE INVENTION

Accordingly, it is an object of this invention to provide a newly improved method for the fabrication of a direct-heated cathode structure and an apparatus which is suitable to carry out the method by which many pressing processes for the corrugate bending of filament ends is reduced to one pressing process and the electric resistance welding between the filament and lead bars is simplified, thus solving the above described problems hitherto.

In order to achieve the aforementioned object, this invention provides a method for the fabrication of a direct-heated cathode structure comprising a bending process wherein the bending is carried out by a plurality of hollow punches, those are assembled around a center shaft each with cushion springs of different elastic moduli inside the hollows thereof and press a filament material with time intervals between each punches thus making the filament material corrugate-ended; and a welding process wherein an end of corrugate-ended filament is put on an upper end of bent lead bar, then electrodes of an electric resistance welder are put on the filament end and beneath said lead bar end respectively to carry out the welding.

According to the another aspect of this invention, it is also provided an apparatus which is suitable to carry out the said method comprising a corrugate bender assembly and a welding jig assembly so being prepared to perform the said bending process and the said welding process respectively.

BRIEF DESCRIPTION OF THE DRAWINGS

Other objects and advantages of this invention will become apparent from the following description of embodiments with reference to the accompanying drawings in which:

FIG. 3-B illustrates a W-shaped bending; FIG. 3-C illustrates a corrugate bending completed for both bending; and FIG. 3-D illustrates cutting of unnecessary parts from the filament;

DETAILED DESCRIPTION OF THE INVENTION

Figure 1:
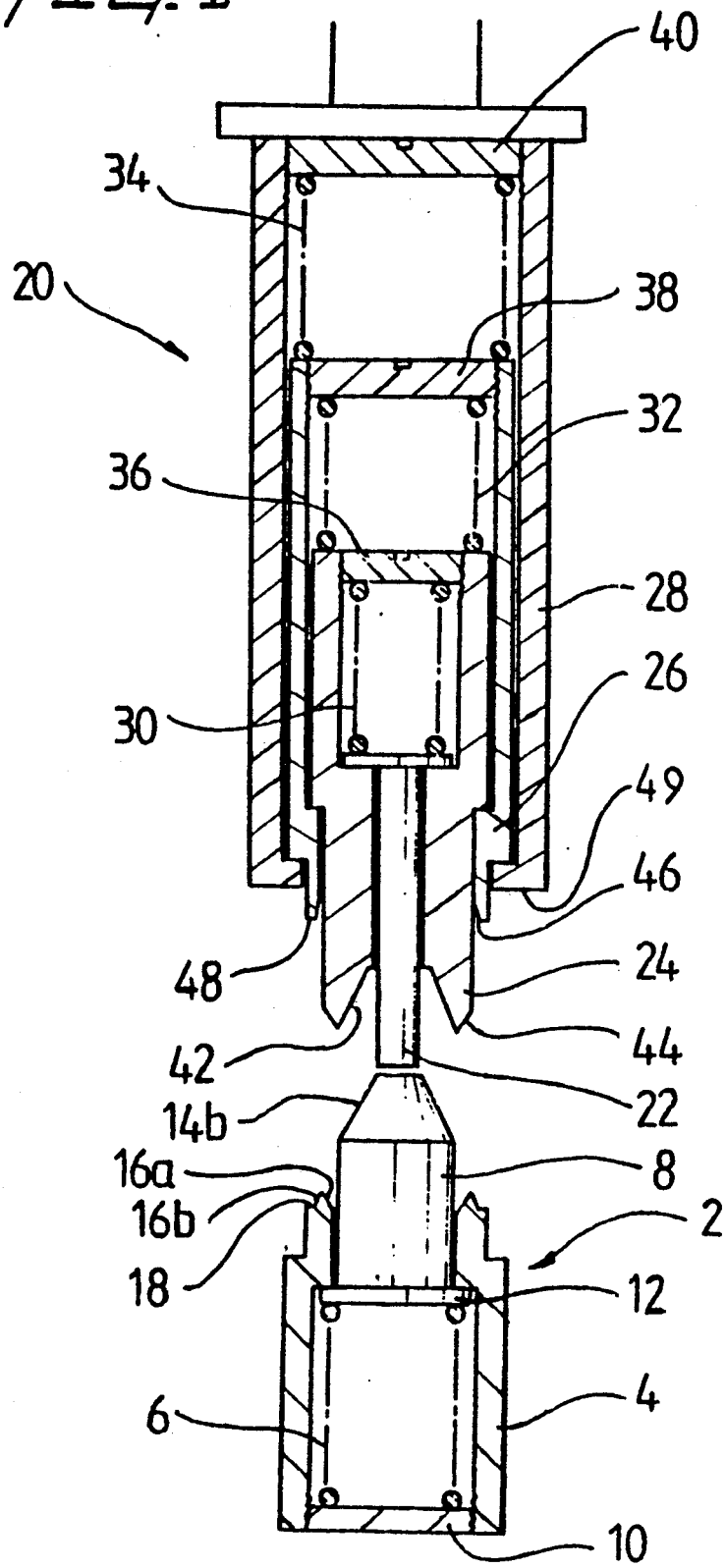
FIG. 1 shows a sectional side elevation illustrating the structure of a punch assembly and a cushion die for the bending that embodies the method for the fabrication of the direct-heated cathode structure according to this invention.
Figure 2:
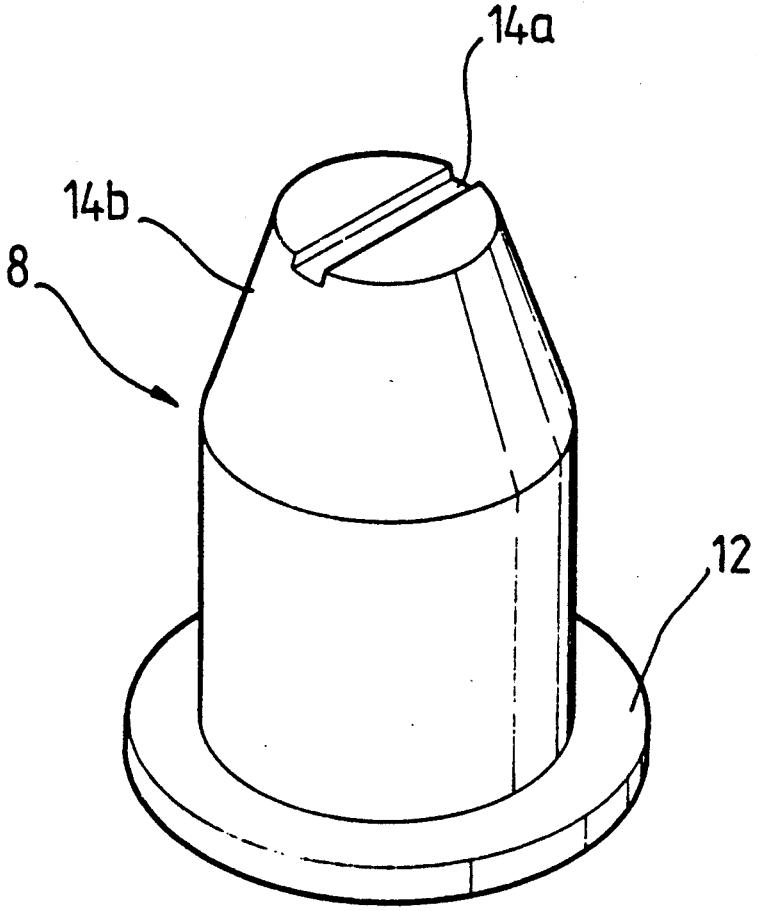
FIG. 2 shows a perspective view illustrating a cushion die.
Figure 3B:
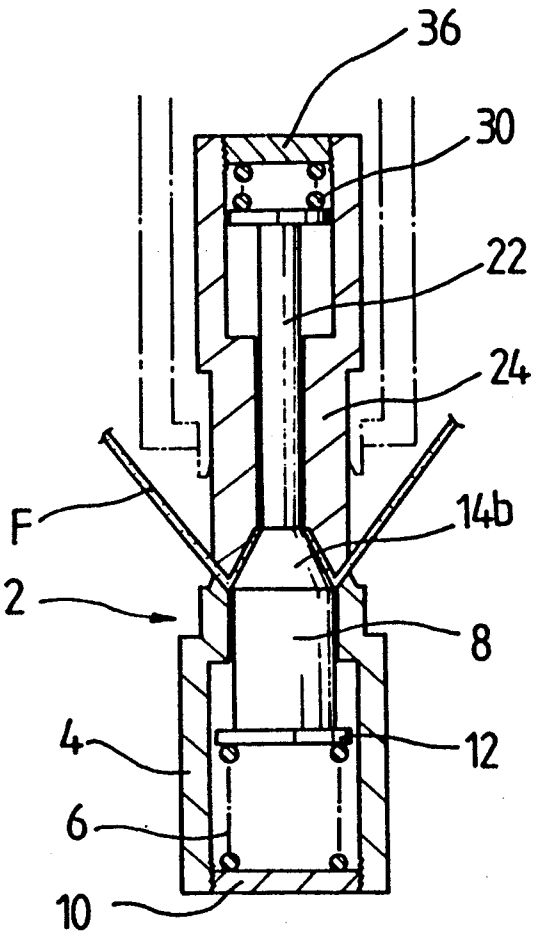
FIG. 3 shows a process of the corrugate bending by the apparatus in FIG. 1, wherein FIG. 3-A illustrates a reversed V-shaped bending.
Figure 3A:
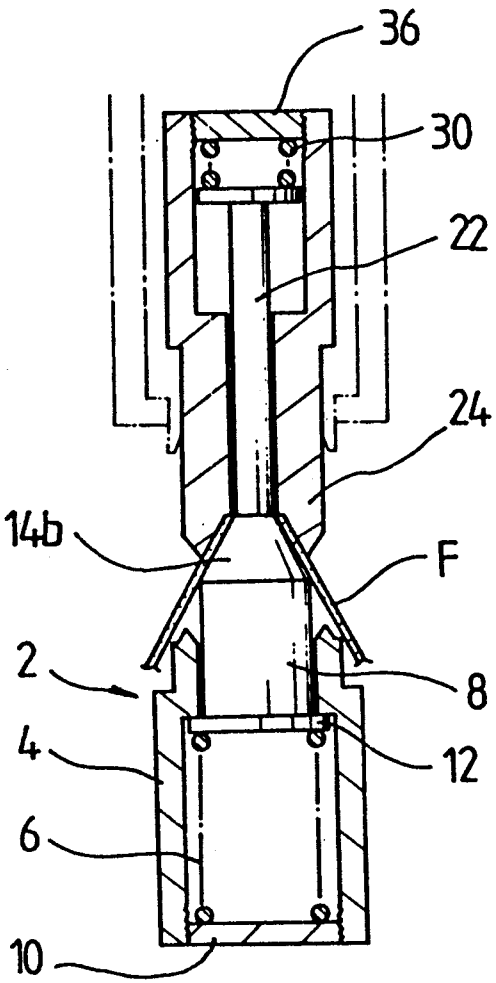
Figure 3D:
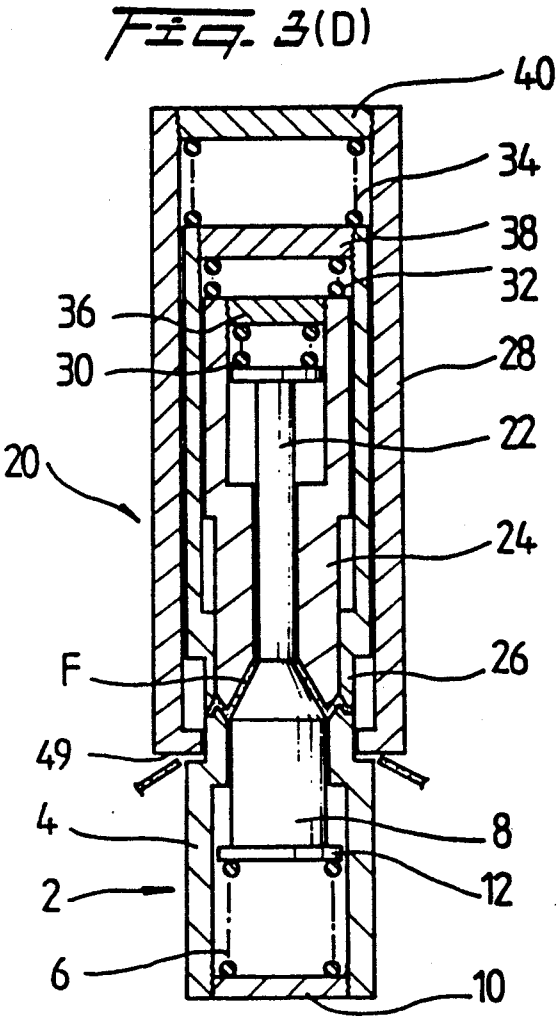
Figure 3C:
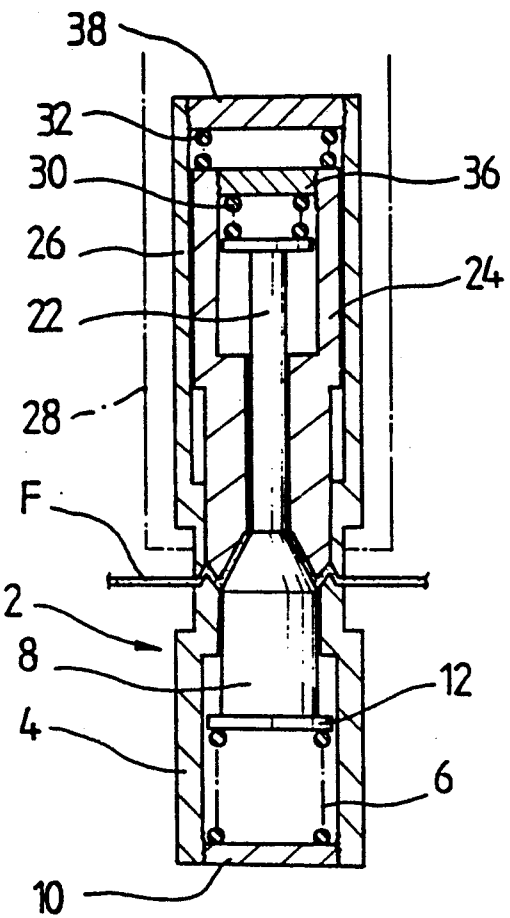

FIG. 1 illustrates an example of corrugate bender assembly that embodies the method of this invention, and numeral 2 in this drawing indicates a cushion die.

The cushion die 2 comprises a cylinder 4 and a die pin 8 which is sustained by an elastic member 6 inside the cylinder 4 and is protruded through its top opening.

The sustaining force of the elastic member 6 against the die pin 8 is adjustable by means of a set screw 10 in the bottom of the cylinder 4.

The protrusion of the die pin 8 sustained by the elastic member 6 is limited by its flange 12 which contacts with the inner shoulder of the cylinder 4; and there is a cross slot 14*a* on the top of the die pin 8 which has an inclined face 14*b* in its upper part thus forming a circular cone with its top cut.

The depth and the width of the above mentioned cross slot 14*a* are so set to meet the thickness and the width of filament materials respectively.

The cylinder 4 with the protruded die pin 8 through the center of its top opening has the cross-section of its wall top a reversed V-shaped by two inclined faces 16*a* and 16*b*; and the foot of one inclined face 16*b* meet with a horizontal face 18.

A punch assembly 20 is disposed above the aforementioned cushion die 2. This punch assembly 20 comprises a center shaft 22 which is supposed to press a filament material on the top face of the die pin 8, a first punch 24, a second punch 26 and a cutter 28 all are concentered with the center shaft 22 and are superposed on it.

The center shaft 22 is sustained by a first elastic member 30 inside the first punch 24, likewise the first punch 24 is sustained by a second elastic member 32 inside the second punch 26, and the second punch 26 is sustained by a third elastic member 34 inside the cutter 28.

Elastic forces of above mentioned elastic members 30, 32, 34 are adjustable by means of set screws 36, 38, 40 in the top faces of the first punch 24, the second punch 26 and the cutter 28 respectively.

The first punch 24 at its lower end has an inclined punch face 42 which corresponds with the inclined face 14*b* of the die pin 8; the outer perimeter of the inclined punch face 42 extends to a reversely inclined punch face 44 which corresponds with the inclined face 16*a* of the cylinder 4.

The second punch 26 which is diposed outside the first punch 24 also has an inclined punch face 46 which corresponds with the inclined face 16*b* of the cylinder 4 and a horizontal face 48 which is extended from the outer perimeter of the inclined punch face 46 at its lower end; the horizontal face 48 of the second punch 26 hence corresponds with the horizontal face 18 of the cylinder 4.

The cutter 28 which admit the second punch 24 inside it has a cutter blade 49 at the inner perimeter of its lower end.

FIG. 3 illustrates a process wherein both ens of the filament material are corrugated by the above described punch assembly.

Filament materials F are supplied in a form of continuous strip and are placed in the cross slot 14*a* formed on the top face of the die pin 8, then the punch assembly 20 is moved downward subsequently.

As the punch assembly 20 is moved downward, the center shaft 22 presses the filament materials F put on the die pin 8 firstly, and the first punch 24 is moved downward compressing the first elastic member 30 and is contacted with the die pin 8 subsequently.

FIG. 3-A illustrates a reversed V-shaped filament material F bended along the inclined face 14*b* of the die pin 8 as the result of the above.

According to continued downward movement of the punch assembly 20 after the punching by the first punch 24 is finished, the die pin 8 compresses the elastic member 6 and retreats into the cylinder 4; thus both ends of the filament material are bended between the inclined face 16*a* in the cylinder 4 and the inclined punch face 44 of the first punch 24 forming a W-shape as shown in FIG. 3-B. Here, residual stresses developed at bended parts of the filament material F will be perished soon beacuse the first punch 24 continue pressing the filament material F on the die pin 8 as the downward movement of the punch assembly 20 is continued after the bending of the filament material F into W-shape.

The continued downward movement of the punch assembly 20 lead the second punch 26 to compress the second elastic member 32 and to move downward along the surface of the first punch 24; as the result, the second punch 26 together with the upper fringe of the cylinder 4 bends both ends of the filament material F into a corrugate shape.

Likewise, the doward movement of the punch assembly 20 is continued after the filament material F is bended into the corrugate shape, and finally lead the cutter 28 to compress the third elastic member 34 and to move downward along the surface of the second punch 26. By this, both ends of the filament material F are cut in adequate length, and the downward movement of the punch assembly 20 is finished.

Next to aboves, the punch assembly 20 starts to move upward and its parts are parted from corresponding parts of the cushion die 2 in a reversed order from the aboves.

In the aboves, the corrugate bending process is explained in stages so as to constitute a minute description for the process, however action of the punch assembly 20 comprising the center shaft 22, the first punch 24, the second punch 26 and the cutter 28 those engage with corresponding parts of the cushion cylinder 2 is carried out in one continued process in an actual process.

Relative magnitude of elastic force of each elastic members those sustain corresponding parts in the punch assembly and the cushion die are set in an order of:

the 1 st elastic member 30<the elastic member 6 in the cylinder 4<the 2nd elastic member 32<the 3rd elastic member 34, according to stages in the process.

Figure 4:
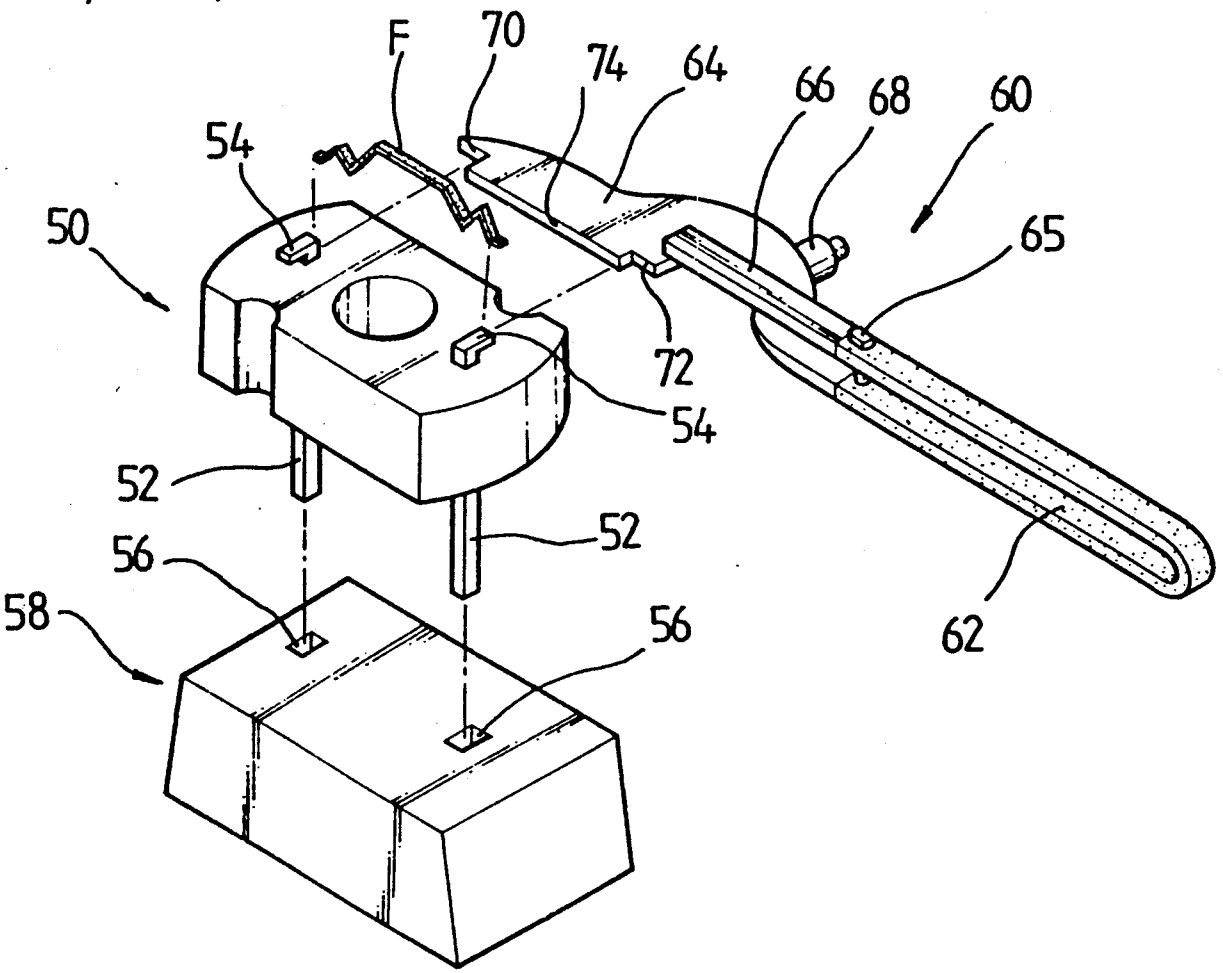
FIG. 4 shows a perspective view illustrating one welding jig that embodies the method of this invention.

FIG. 4 illustrates one electric resistance welding jig which embodies the fabrication method in this invention. Here, the numeral 50 indicates a conventional filament supporting base. To the base 50 is fixed a pair of lead bars 52 whose each upper ends form welding seats 54 on which both ends of a filament material F shall be welded to.

The above mentioned welding seat 54 has its upper end bended normally in order that it may provide a larger welding area for the case of a thin strip-shaped lead bar.

An electric resistance welding assembly which weld both ends of the filament material F on the said welding seats 54 comprises:

a block 58 with a pair of holes formed on it to support temporarily the base 50 which carries said lead bars 52; and a welding jig 60 which guide said welding seats 54 and both ends of the filament material F in correct position during the electric resistance welding.

The above mentioned welding jig 60 includes a U-shaped handle 62 which has its surface insulated; a guide plate 64 is attached at one end of the handle 62 and a guide bar 66 adjusted by a stopper 65 is attached at the other end of the handle 62.

The guide plate 64 at its one side includes an electrode 68 whereto a terminal of a conventional welding transformer will be connected, and the other side of the guide plate 64 is formed into two contact slots 70, 72 of different depths (70 is deeper than 72) and a spacer part 74 between them. The length of this spacer part 74 is equivalent to the distance between lead bars 52 which are fixed on the base 50.

The above mentioned guide plate 64 act as an electrode when an alternating potential is impressed to said electrode 68.

Figure 5:
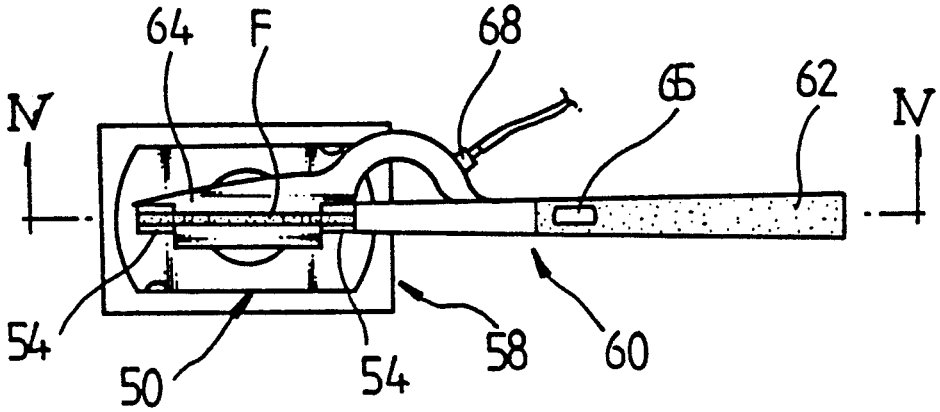
FIG. 5 shows a plan illustrating use of the welding jig in FIG. 4.

FIG. 5 shows a plan illustrating the application of the above described welding jig.

The spacer part 74 of the guide plate 64 is inserted between both lead bars 52 fixed to the base 50 which is supported temporarily by the block 58; one contact slot 72 near to the handle 62 engages under one welding seat 54 which is located at right side in FIG. 5, and the other contact slot 70 engages around the other welding seat 54.

Figure 6:
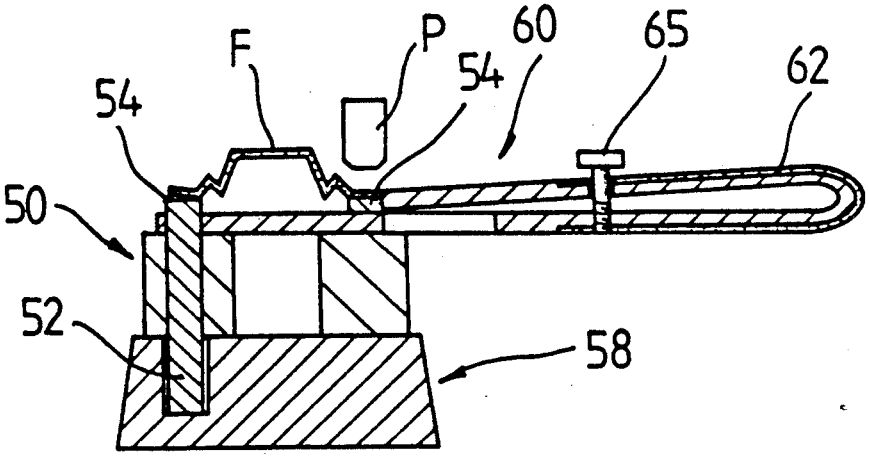
FIG. 6 shows a sectional side view of FIG. 5 along the line IV—IV.

In this way, welding seats 54 of both lead bars 52 maintain their interspace by leaning against the spacer part 74 as shown in FIG. 6 and they are supported to endure the pressure applied by an upper electrode P during the welding. And an end of the filament material F which is put on said welding seat 54 lean against the guide bar 66 thus enabling a precise welding.

The structure of welding jig is not confined by the above described embodiment and it can be constructed in several altered forms so far it does not go beyond the idea of this invention.

Figure 7:
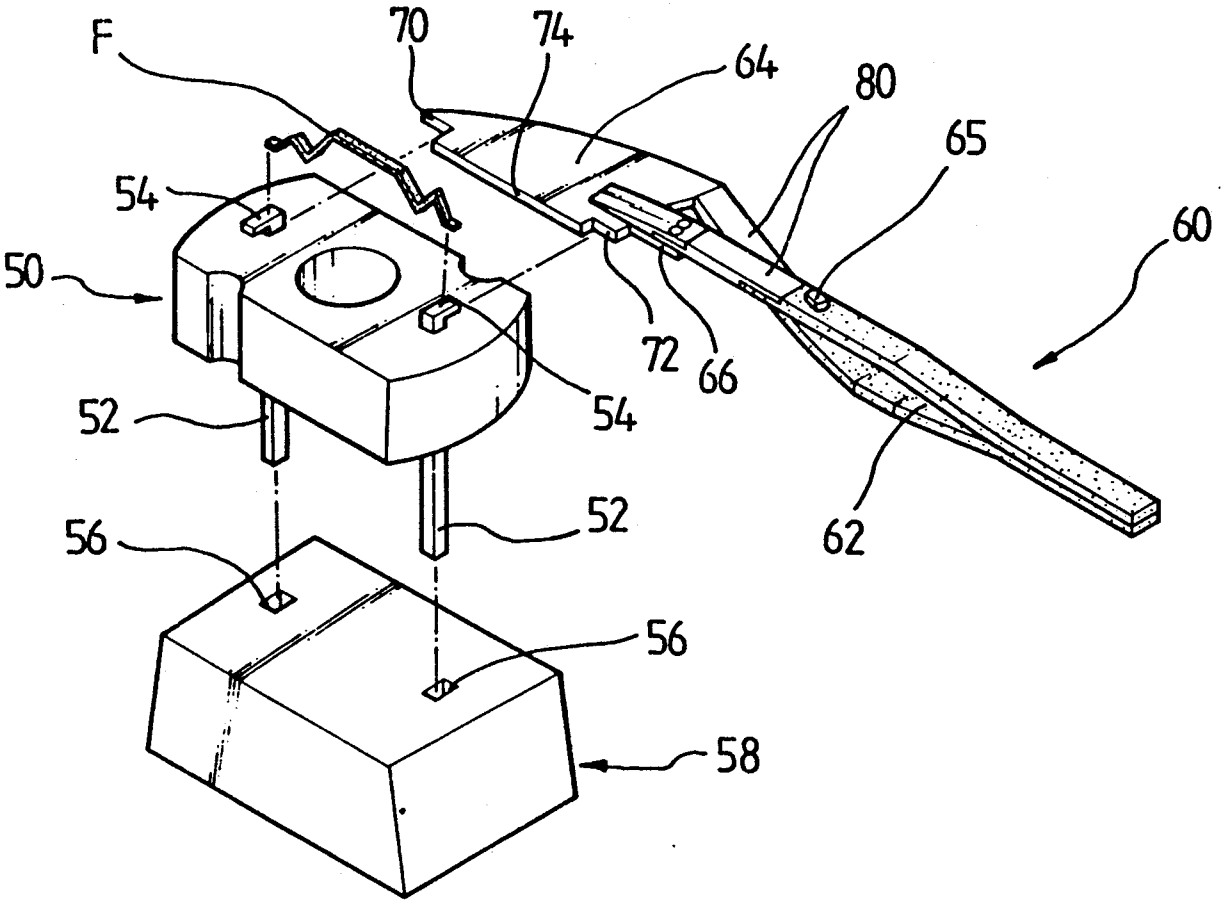
FIG. 7 shows a perspective view illustrating another welding jig that embodies the method of this invention.
Figure 8:
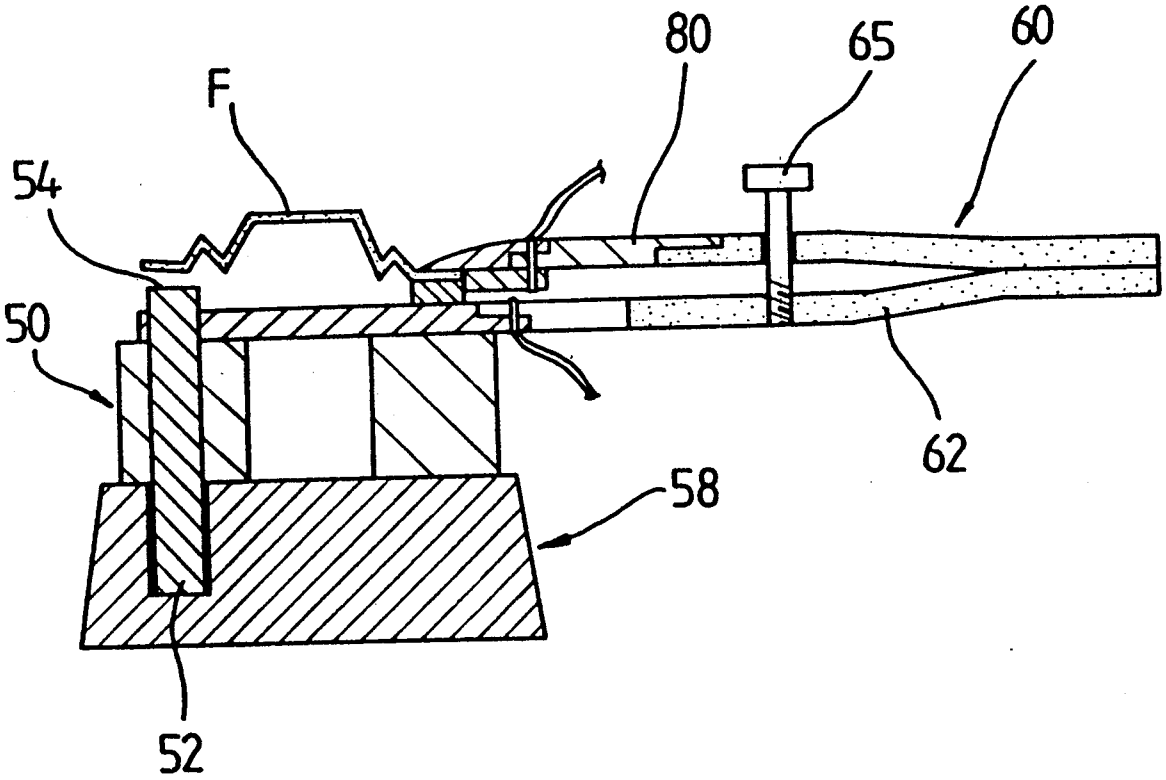
FIG. 8 shows a sectional side view of FIG. 7 along a line which is equivalent to the line IV—IV in FIG. 5.

FIG. 7 illustrates another welding jig embodiment related to this invention.

The basic structure of this embodiment is similar to that of the above mentioned embodiment (hereinafter called as the former embodiment), therefore description of same parts for both of them are omitted hereafter.

This embodiment is featured by that the electrode P is attached on the guide bar 66.

The guide plate 64 and the electrode P faces each other; insulation materials are put between the handle 62 and the guide plate 64 and also between the handle 62 and the electrode P respectively so as to isolate electrically the guide plate 64 and the electrode P.

The welding process carried out by this embodiment is same with that of the former embodiment except that an end of the filament material F in this embodiment is engaged between the guide bar 66 and the electrode P thus the welding of the filament material F became more stable and more precise than in the former embodiment.

As described above, the fabrication of a direct-heated cathode structure with a corrugate-ended filament became more convenient, and relevant fabrication equipments are remarkably simplified according to the present invention.

What is claimed is:

1. A method for the fabrication of a direct-heated cathode structure comprising the subsequent steps of:

(a) bending step of filament materials including the stages wherein: filament materials are pressed by a center shaft on a die pin; both ends of said filament materials are bent into a reversed V-shape by a first punch; said die pin is retreated inside a cylinder thus making said filament materials bent into a W-shape; and both ends of said filaments are bent into a corrugate shape by a second punch together with an upper fringe of said cylinder (b) welding step of ends of said filament material on to welding seats wherein lead bars fixed to a conventional base are adjusted and disposed at a required position, and said welding seats are supported so as not to be deformed by a pressure applied from an electric resistance welding electrode.

2. A method for the fabrication of a direct-heated cathode structure as set forth in claim 1 including cutting both ends of said filament material into a predetermined length by a cutter following the said bending into corrugate shape.

3. A method for the fabrication of a direct-heated cathode structure as set forth in claim 1 wherein said filament materials are supplied on to the top of said die pin in a strip-shape.

4. A fabrication apparatus for assembling a direct-heated cathode structure comprising:

(A) corrugate bender assembly including:

a cushion die including a die pin sustained by an elastic member inside a cylinder, said die pin together with the upper fringe of said cylinder forming a die face for said bending; and a punch assembly including a center shaft, a first punch and a second punch, those parts being sustained by a first elastic member, by a second elastic member and by a third elastic member respectively, and a cutter, all parts being concentric to said center shaft;

(B) a welding jig assembly including:

a block with a pair of holes formed on it so disposed to support a conventional cathode filament base; and a welding electrode jig means comprising a guide plate means having an electrical contact slot adapted to engage a lead of said cathode filament base, an adjustable guide bar means for aligning the filament with said lead, and electrical connection means for impressing a welding current to said plate means and thus to said lead.

5. A fabrication apparatus for directheated cathode structure as set forth in claim 4 wherein the relative magnitudes of elastic force of said elastic members are set in an order of:

the 1st elastic member < the elastic member in said cylinder < the 2nd elastic member < the 3rd elastic member.

6. A fabrication apparatus for said direct-heated cathode structure as set forth in claim 4 wherein said guide plate means includes two contact slot means, and the interspace between two said contact slots is equivalent to the distance between two lead bars on said cathode filament base.

7. A fabrication apparatus as set forth in claim 6 including a U-shaped handle having a first end tine supporting said plate means and a second end tine supporting said guide bar means, and wherein said contact slots are of different depth.

8. A fabrication apparatus for said direct-heated cathode structure as set forth in claim 4 wherein a welding electrode is attached on said guide bar, and that said guide bar and said guide plate are connected to the insulation tines of a U-shaped handle respectively with insulation materials put between them and said handle.

* * * * *